US008182244B2

(12) United States Patent
Cadeddu

(10) Patent No.: US 8,182,244 B2
(45) Date of Patent: May 22, 2012

(54) VACUUM PUMP PROVIDED WITH A DEVICE FOR ITS DEACTIVATION

(75) Inventor: Leonardo Cadeddu, Crema (IT)

(73) Assignee: VHIT S.p.A., Offanengo (IT)

( * ) Notice: Subject to any disclaimer, the term of this patent is extended or adjusted under 35 U.S.C. 154(b) by 478 days.

(21) Appl. No.: 12/518,346

(22) PCT Filed: Sep. 11, 2007

(86) PCT No.: PCT/EP2007/007969

§ 371 (c)(1),
(2), (4) Date: Jun. 9, 2009

(87) PCT Pub. No.: WO2008/071243

PCT Pub. Date: Jun. 19, 2008

(65) Prior Publication Data

US 2010/0034675 A1 Feb. 11, 2010

(30) Foreign Application Priority Data

Dec. 11, 2006 (IT) ..... TO2006A0876

(51) Int. Cl.
*F04B 17/00* (2006.01)

(52) U.S. Cl. ..... 417/410.3; 418/185; 418/255

(58) Field of Classification Search ..... 417/321, 417/322, 310, 410.3; 418/185, 186, 253–258, 418/270; 91/437; 251/129.01; 137/522, 137/523; 192/58.9–58.92, 58.1–58.2
See application file for complete search history.

(56) References Cited

U.S. PATENT DOCUMENTS

| | | | | |
|---|---|---|---|---|
| 3,029,899 | A * | 4/1962 | Hutton | 185/37 |
| 3,556,156 | A * | 1/1971 | Fuller, Jr. | 138/43 |
| 3,938,076 | A * | 2/1976 | Hayashi | 340/448 |
| 4,642,725 | A * | 2/1987 | Vincent et al. | 361/154 |
| 4,734,187 | A * | 3/1988 | Visentin et al. | 210/101 |
| 4,820,130 | A | 4/1989 | Eber et al. | |
| 5,487,407 | A * | 1/1996 | Eaker | 137/522 |
| 6,648,012 | B2 * | 11/2003 | Linthorst | 137/522 |
| 2006/0240686 | A1 * | 10/2006 | Jiten | 439/66 |
| 2011/0196320 | A1 * | 8/2011 | Ross et al. | 604/294 |

FOREIGN PATENT DOCUMENTS

| | | |
|---|---|---|
| DE | 10 2004 018 567 | 12/2005 |
| JP | 59-70894 | 4/1984 |
| JP | 10-110692 | 4/1998 |
| WO | 2006/010528 | 2/2006 |

OTHER PUBLICATIONS

International Search Report dated Nov. 28, 2007, from corresponding PCT application.

* cited by examiner

*Primary Examiner* — Devon C Kramer
*Assistant Examiner* — Dnyanesh Kasture
(74) *Attorney, Agent, or Firm* — Young & Thompson

(57) ABSTRACT

A vacuum pump has inside the pumping chamber valves intended to control the operation by opening and closing during the suction and delivery cycle of the pump. The valves or parts connected thereto are formed at least in part by a ferromagnetic material. A magnetic inductor is applied outside a wall, formed by a non ferromagnetic material, of the pumping chamber of the pump, and inside the pumping chamber are installed conducting elements of ferromagnetic material, for conducting magnetic flow produced, by the inductor, up to polar points close to the positions taken in the conditions of inactivity by the valves, so as to magnetically attract the valves (10,20) in an inactivity position when the inductor is operated, and thus stop the pneumatic operation of the pump without stopping its motion which then becomes idle.

9 Claims, 2 Drawing Sheets

FIG. 3
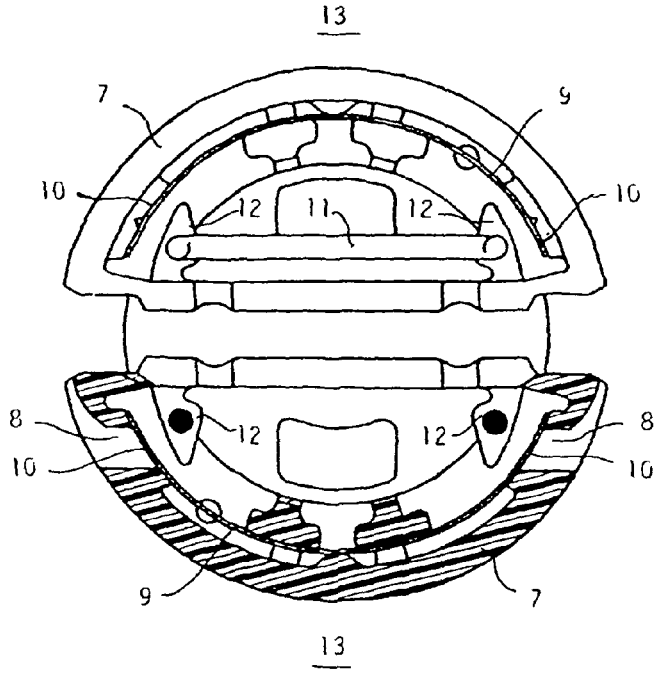
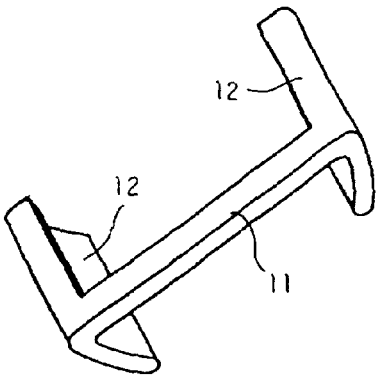
FIG. 5
FIG. 4
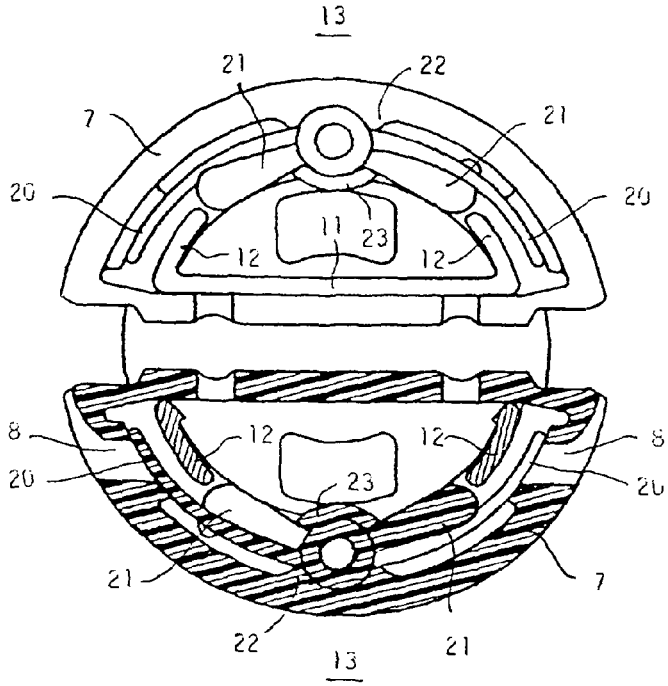

VACUUM PUMP PROVIDED WITH A DEVICE FOR ITS DEACTIVATION

The subject of the present invention is a vacuum pump provided with a device intended to stop the operation of the pump during the period in which its function is not required.

In the automotive field are used pumps, generally called "vacuum pumps", for the most part vane pumps, whose function is to generate and maintain a depression in an air tank. This depression is mainly used for operating pneumatic servomotors for the assisted braking, as well as possible other apparatuses which require a depression for their operation. After the depression has been initially generated, the operation of these pumps serves for compensating the depression consummation effected by the apparatuses connected to the depressed tank, and the leakages. Because these apparatuses are not active in permanence, and the leakages are limited, there are periods of noticeable duration wherein the operation of the pump is unnecessary. However, according to the usual technique, these pumps are permanently driven by the engine. It ensues a unnecessary power consumption and therefore some increase in the fuel consumption and the emission of burnt gases, as well as a unnecessary wear of the component parts of the pump.

The deactivation of the pump during the periods in which its operation is not needed allows to reduce the overall power required to the engine and therefore the fuel consumption and the emission of burnt gases, as well as to reduce the wear of the component parts, thus increasing their duration, and moreover, by reducing the stresses of the materials, to render possible the choice of alternative less costly materials for manufacturing the component parts of the pump. For this reason some devices have been developed, intended to stop the drive of the vacuum pump during the periods in which its operation is not needed.

A particularly improved device intended to this purpose is described in the Italian Patent Application No. TO 2004 A 000 530. It is intended to be inserted between the rotating system of the pump and the component part of the engine that transmits the drive to the pump, in order to transmit the movement when the operation of the pump is required, and to stop the movement transmission during the periods in which said operation is not needed, thus leaving motionless or about motionless the pump during these periods. However, this device requires that an additive component part is inserted in the drive system of the pump.

In view of the above, a main object of this invention is to provide a vacuum pump comprising a device capable of deactivating the operation of the pump during the periods in which the operation is not needed, but without interrupting the mechanical drive of the pump, and therefore without requiring the insertion of any additional component part in the drive system of the pump. Another object is to attain said main object with relatively simple, reliable and inexpensive means.

This invention applies in particular to those kinds of vacuum pumps which comprise inside the pumping chamber some valves controlling the pump operation by opening and closing during the suction and delivery cycle of the pump. Examples of such vacuum pumps are described in the Italian Patent Application No. TO 2006 A 000 673. In the pumps described in this document, the valves controlling the operation are mounted inside the pump rotor.

The main object of the present invention is attained by means of a vacuum pump, of the type comprising inside the pumping chamber valves intended to control the operation by opening and closing during the suction and delivery cycle of the pump, characterized in that:—said valves or some parts connected thereto are formed at least in part by a ferromagnetic material;—a magnetic inductor is applied outside a wall, formed by a non ferromagnetic material, of the pumping chamber of the pump;—and inside the pumping chamber are installed conducting elements of ferromagnetic material, suitable for conducting the magnetic flow produced, directly or indirectly, by said inductor, up to polar points close to the positions taken in the conditions of inactivity by said valves or parts connected thereto, so as to magnetically attract the valves in an inactivity position when said inductor is operated, and thus stop the pneumatic operation of the pump, even without stopping its motion, which then becomes idle.

In particular, when said valves are installed in a rotor housed in the pumping chamber, said conducting ferromagnetic elements are installed in the pump rotor too. More in detail, when the inactivity condition of the valves corresponds to their open position, each magnetic flow conducting element has a polar point situated in a position near the stop member that limits the opening displacement of the corresponding valve.

In particular, the ferromagnetic parts connected to the valves can be intermediate ferromagnetic members arranged for receiving the action of the magnetic field and to mechanically act onto the valves.

The magnetic flow conveyed by said elements conducting the magnetic flow can be directly the magnetic flow produced by said inductor, or else it can be a magnetic flow produced by said inductor in an indirect manner by acting onto an electric winding situated inside the pumping chamber. On its turn, this electric winding situated inside the pumping chamber can be installed in a fixed position; and in this case the inductor should produce an alternate magnetic flow, or else the inner electric winding can be installed onto a rotating part of the pump, and it can receive the electromagnetic induction thanks to its own movement within the magnetic induction field produced by the outer inductor.

In this last case, the outer inductor can be an electromagnetic inductor supplied by direct current, or it can be a permanent magnet. In this last case some means should be provided for admitting or intercepting the transmission towards the pumping chamber of the magnetic flow produced by the inductor.

It is to be understood that the definition of "ferromagnetic material" as used in this description includes any material having high magnetic susceptibility, and therefore the iron alloys, and other metallic alloys or synthetic materials having high magnetic susceptibility, either due to their own nature or by the presence of charges having high magnetic susceptibility.

These and other features, objects and advantages of the subject of the present invention will more clearly appear from the following description of three preferred embodiments being not limiting examples, with reference to the accompanying drawings, wherein:

FIG. 3 shows in a manner similar to FIG. 2 a second embodiment of a rotor with valves, being a part of a vacuum pump equipped according to the invention.

FIG. 4 shows in a manner similar to FIG. 2 a third embodiment of a rotor with valves, being a part of a vacuum pump equipped according to the invention.

FIG. 5 shows in perspective the conformation of the ferromagnetic bridges used according to FIG. 4.

The device according to the invention is mainly suitable for the application to a vacuum pump for automotive use according to the Italian Patent Application No. TO 2006 A 000 673, and for this reason the following description is referred to said application, but the invention may find use in all cases of vacuum pumps wherein one or more valves, intended to control the operation of the pump, are installed inside the pumping chamber, either in fixed position or within the pump rotor.

Figure 1:
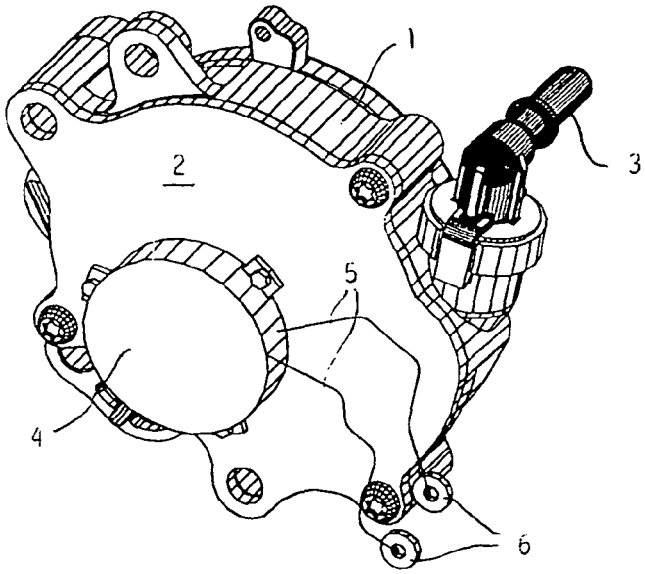
FIG. 1 is an external perspective view of a vacuum pump equipped according to the invention.

With reference to FIG. 1, there is represented in an external view a vacuum pump comprising a body 1 inside which is situated the pumping chamber, said body 1 being closed by a cover 2 and having a suction connection 3. These parts do not differ anyway from the corresponding conventional parts and therefore they do not require a detailed description. The characteristic of the invention resides in the fact that a magnetic inductor 4 is applied outside a wall of the pumping chamber, in this case preferably the cover 2, said wall being formed of a non ferromagnetic material. In the embodiment shown, the inductor 4 is an electromagnetic inductor and it has cables 5 for electric supply, which terminate with connection clamps 6. It is needed that the wall (in this case the cover 2) to which is applied the inductor 4 be formed of a non ferromagnetic material, in order that the magnetic field generated by inductor 4 extends inside the pumping chamber.

Figure 2:
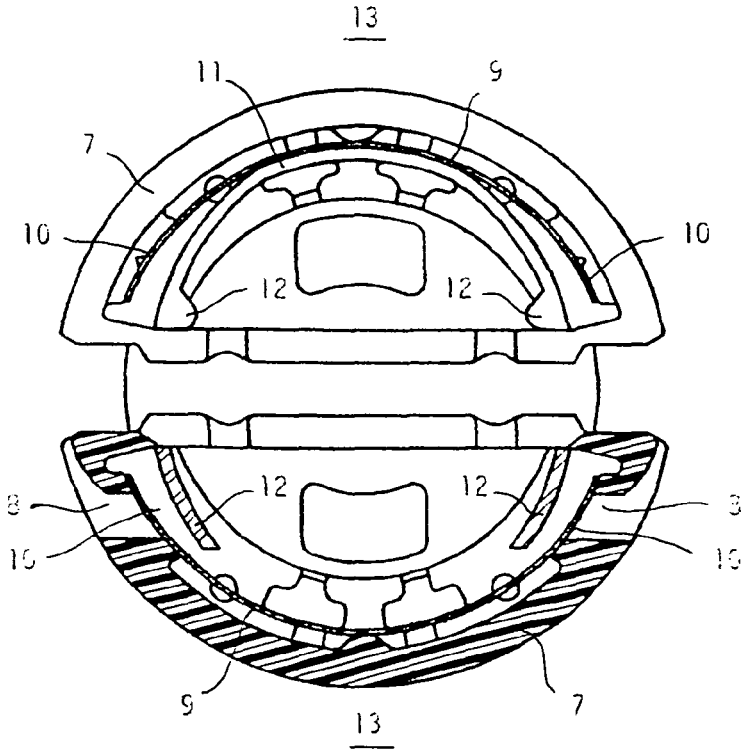
FIG. 2 illustrates, in view in the upper part and in cross section in the lower part, a first embodiment of a rotor with valves, being a part of a vacuum pump equipped according to the invention.

FIG. 2 represents, in the upper part in view and in the lower part in cross-section, a rotor 7 inserted in a pumping chamber represented by the space 13 surrounding rotor 7. The pumping chamber 13 is housed in the pump body 1.

In the shown embodiment, rotor 7 conforms generally the rotor represented in FIG. 3 of the Italian Patent Application No. TO 2006 A 000 673. For the details of the operation of such a rotor, reference is made to the explications contained in the description of said Application, but for the matter concerning this invention it is sufficient to recall the following.

Rotor 7 comprises four valves that control the passage of the air present in the pumping chamber 13 through four openings 8, of which two are visible in the section of the lower part of FIG. 2. The valves are formed by the end portions 10 of elastic leaf springs 9. These valves are movable between the represented position, a closed rest position, wherein the valves 10 rest against the borders surrounding the openings 8 and close these openings, and an open position in which the end portions 10 of the leaf springs 9 are lifted from the openings 8 and rest against stop members 12. These displacements of valves 10 are caused by the pressures present in the pumping chamber 13 in the regions of the corresponding openings 8 of rotor 7. If all valves 10 were open, the rotor 7 would turn idle and the pump would stop its operation.

In the application to this invention, the elastic leaf springs 9 should be formed of a ferromagnetic material having reduced magnetic hysteresis, such as for example a steel of suitable quality, and the stop members 12 are formed by the end portions of arcuate bridges 11. An arcuate bridge 11 is entirely visible in the view of the upper part of FIG. 2, whereas in the cross section of the lower part of FIG. 2 are only visible the end portions of the corresponding bridge, which form the stop members 12. The bridges 11 and their end portions 12 should be formed by a ferromagnetic material having reduced magnetic hysteresis, such as for example iron. The reason for which the mentioned parts should have a reduced magnetic hysteresis is that they should not retain a noticeable permanent magnetization after they have been subjected to a magnetic induction field.

In the absence of excitation of the electromagnetic inductor 4, in the pumping chamber 13, wherein the rotor 7 is housed, is not present any magnetic induction field, and rotor 7 operates in the normal manner, with its valves 10 that open and close periodically, according to the pressures acting thereon. The pump operates in the normal manner.

On the contrary, when the electromagnetic inductor 4 is excited by supplying thereto electric current through the cables 5, the inductor 4 generates a magnetic induction field and, because the cover 2 is of a non ferromagnetic material, this field extends into the pumping chamber 13 delimited by the cover 2, and therefore also into the space occupied by rotor 7. Being subjected to this magnetic induction field, the bridges 11 that are formed by ferromagnetic material take the character of magnetic dipoles, and their end portions 12, forming the stop members facing the end portions 10 of the leaf springs 9, become magnetic poles and magnetically attract the end portions 10 forming the valves of the pump.

The valves 10 come therefore to rest against the stop members 12, which determine their open positions, and they remain in this position as long as the inductor 4 is supplied by electric current. Then the pump is idle due to the permanent opening of valves 10, and this condition persists as long as the inductor 4 is excited. Rotor 7 continues to rotate in the normal manner, but it does not cause any air suction through the connection 3. When the inductor 4 ceases to be excited, the magnetic induction field produced by the inductor is canceled, the bridges 11 are no more magnetized, and the polar end portions 12 thereof cease to magnetically attract the valves 10. Then the valves 10 take again their normal operation, and the pump begins again its suction action through the connection 3.

Therefore, it is sufficient to control by electric way the excitation of inductor 4 for controlling the activation and the deactivation of the vacuum pump. The vacuum pump continues in permanence to rotate, but during the periods in which it is deactivated it opposes no resistance to the rotation, except for the friction of its parts, and therefore it absorbs a mechanical power practically null and is subjected to minimum stress and wear.

FIG. 3 represents, in view in the upper part and in cross section in the lower part, an embodiment of the rotor 7 that generally conforms the rotor 7 represented in FIG. 2. The difference with respect to the former embodiment concerns the bridges 11, whose end portions form the poles 12 intended for magnetically attracting the valves 10. In this embodiment, the bridges 11 are rectilinear rather than arcuate. The operation remains identical. It is to be noted that the shape of the bridges 11 is not critical for the operation, however a suitable choice of this shape allows exploiting in the best manner the magnetic induction field produced by the inductor 4, by taking in account the course of the magnetic field within the pumping chamber, course that depends on the conformation chosen for the inductor 4.

FIG. 4 represents, in view in the upper part and in cross section in the lower part, an embodiment of the rotor 7 that generally conforms the rotor shown in FIG. 7 of the Italian Patent Application No. TO 2006 A 000 673. The general conformation of the bridges 11-12 used in this embodiment is represented in FIG. 5. In this case, the valves 20 are not formed by the end portions of leaf springs, but they are part of superimposed balances 20-21 pivoted to the rotor 7. The pivot connection can be realized by coupling a cylindrical central portion of each balance with suitable conformations of the rotor 7, and particularly, as represented, between a portion 22 shaped as a cradle and a portion 23 shaped as a tile. In this case, the closure position of the valves 20 is not determined by the elasticity of leaf springs, but by the centrifugal force due to the rotation of rotor 7, suitably moderated by the counterweight action of the portions 21 of the balances, opposite the valve portions 20. Also in this case, at least the balance portions 20 forming the valves should be formed of a ferromagnetic material having a reduced magnetic hysteresis. As it may be easily understood, the operation of this embodiment remains identical to the operation of the previous embodiments. The valves 20 are magnetically attracted by the poles 12, forming stop members, of the bridges 11, when the inductor 4, excited, produces a magnetic induction field inside the pumping chamber and in the space 13 occupied by the rotor 7.

It has been told in the foregoing that the parts forming the valves 10 or 20 should be of ferromagnetic material in order to be magnetically attracted by the poles 12 that form the stop members for the valves in their open positions. But, of course, the valves may per se be formed of any non ferromagnetic material, provided that they are solid with other parts of ferromagnetic material, suitable for being attracted by the magnetic poles 12. It could be of advantage to provide intermediate ferromagnetic members arranged for receiving the action of the magnetic field and for mechanically acting onto the valves. It is also clear that, when this appear suitable, the poles 12 intended for magnetically attracting the valves could be separated from the stop members of the valves, provided that their position is suitable for effecting the needed magnetic attraction onto the valves.

In different embodiments, wherein the deactivation of the pump would require that the valves are retained in closure position rather than in open position, the magnetic poles intended to magnetically attract the valves should be situated in a corresponding manner. The device of the invention attains its maximum simplicity when the inductor 4 generates inside the pumping chamber a magnetic induction field that directly acts on the magnetic conduction elements whose poles operate the magnetic attraction of the valves. However in certain cases may be preferable that the magnetic induction field generated by the inductor 4 inside the pumping chamber is used by an electric winding situated inside the pumping chamber, intended on its turn for creating the magnetic induction field used for magnetically attracting the valves. In this case the inductor 4 operates in an indirect way, though attaining the same effects.

It is to be understood that the invention is not limited to the embodiments described and represented as examples. Several possible modifications have been stated in the course of the description, and others are easily designed by those are skilled in the art. These and other modifications, as well as any replacement by technically equivalent means, may be made to what has been described and represented, without departing from the spirit of the invention and from the scope of this patent, as defined by the Claims.

The invention claimed is:

1. A vacuum pump comprising:

a pumping chamber (13) having a rotor (7) and inside said rotor (7) are valves (10,20) to control operation of the vacuum pump by opening and closing during a suction and delivery cycle of the vacuum pump, wherein said valves (10, 20) comprise parts that are at least partially made of a ferromagnetic material;

a magnetic inductor (4) is mounted exterior to the vacuum pump, on a wall of the pumping chamber, said wall being made of a non ferromagnetic material; and conducting elements (11) formed of ferromagnetic material placed inside said rotor (7), said conducting elements (11) conducting a magnetic flow produced by said inductor (4), up to polar points (12) close to positions taken in conditions of inactivity by said valves (10,20), the conducting elements (11) magnetically attract the valves into an inactivity position upon said inductor being operated, and thus stop pneumatic operation of the pump, even without stopping the pump's motion, which then becomes idle.

2. The vacuum pump according to claim 1, wherein, upon attainment of the inactivity condition of said valves (10,20) in which said valves are in an open position each of said magnetic flow conducting elements (11) conducts the magnetic flow to a corresponding one of said polar points (12) that is situated in a position near a stop member (12) that limits an opening displacement of a corresponding valve (10,20).

3. The vacuum pump according to claim 1, wherein said ferromagnetic parts of the valves (10,20) are ferromagnetic members arranged to receive an action of a magnetic field and move towards the valves (10,20).

4. The vacuum pump according to claim 1, wherein the magnetic flow conveyed by said elements (11) conducting the magnetic flow is directly produced by said inductor (4).

5. The vacuum pump according to claim 1, wherein the magnetic flow is produced by said inductor (4) in an indirect manner by acting onto an electric winding situated inside the pumping chamber (13).

6. The vacuum pump according to claim 5, wherein said electric winding situated inside the pumping chamber is installed in a fixed position, and the inductor (4) produces additional magnetic flow.

7. The vacuum pump according to claim 5, wherein said electric winding is installed onto a rotating part (7) of the pump, and the electric winding receives electromagnetic induction in response to the electric winding's movement within a magnetic induction field produced by an outer inductor (4).

8. The vacuum pump according to claim 7, wherein said outer inductor (4) is an electromagnetic inductor that is supplied a current through cables (5).

9. The vacuum pump according to claim 7, wherein said outer inductor (4) is a permanent magnet that either intercepts or admits transmission towards the pumping chamber (13) of the magnetic flow produced by the inductor (4).

* * * * *